US005613791A

United States Patent [19]

Medenica

[11] Patent Number: 5,613,791

[45] **Date of Patent: *Mar. 25, 1997**

[54] MEDICAL FILE FOLDER AND HANGING SYSTEM

[76] Inventor: Rajko D. Medenica, 18 Bee St., Charleston, S.C. 29403

[ * ] Notice: The terminal 57 months of this patent has been disclaimed.

[21] Appl. No.: 568,592

[22] Filed: Aug. 16, 1990

[51] Int. Cl.[6] ..... B42F 13/00; B42F 15/00

[52] U.S. Cl. ..... 402/4; 402/60; 283/900; 281/21.1; 281/15.1; 281/45

[58] Field of Search ..... 281/15.1, 21.1, 281/45; 283/400; 402/4, 60

[56] References Cited

U.S. PATENT DOCUMENTS 4,445,799 5/1984 Wright et al. ..... 402/4

4,679,955 7/1987 Marsh ..... 402/4

*Primary Examiner*—Paul A. Bell

[57] ABSTRACT

A medical file folder comprising a front and back contra-positioned walls with a common foldable spine therebetween. Pertinent patient medical information is displayed and stored on a medical chart printed on the exterior of the front wall of the folder. Medical documents are stored in a pocket of a transparent sheet connected to the back wall of the folder. Additionally, the medical file folder includes a resilient clamp and openable pockets therein for storage of patient information. The medical file folder is easily cataloged by having an identification tab positioned on one edge of front wall. A pair of suspension hooks positioned on the medical file folder allow easy storage on and retrieval from a suspension bar.

7 Claims, 5 Drawing Sheets

MEDICAL FILE FOLDER AND HANGING SYSTEM

FIELD OF THE INVENTION

The present invention relates generally to a container in which records are kept, and more specifically, to a suspendable file folder device having a number of containers which display and store pertinent medical information.

BACKGROUND OF THE INVENTION

The art of providing suitable containers for the storage of documents has been pursued extensively for many years. As a result, a large number of patents have been issued for various envelopes and file folders.

One such device is disclosed in U.S. Pat. No. 4,313,558 to Benham wherein an expandable envelope is formed of a plurality of pockets. Other such multi-pocketed containers are described in U.S. Pat. No. 4,415,183 to Benham, U.S. Pat. No. 3,933,294 to Meenan et al., and U.S. Pat. No. 3,858,790 to Humphrey.

In U.S. Pat. No. 3,870,223 to Wyant a portfolio is described having two pockets within a foldable container. U.S. Pat. No. 4,262,828 to Mackenzie discloses a container for a plurality of file folders. U.S. Pat. No. 4,602,734 to Thompson discloses a similar type device wherein an enclosed container is provided for documents.

Other sectionalized folders are well-known in the art. U.S. Pat. No. 4,636,179 to Gentile et al. provides a folder with three integrally-formed pockets. In U.S. Pat. No. 4,589,544 to Schweinsberg a filing arrangement is disclosed wherein hooked-shaped folders are hung upon one another. U.S. Pat. No. 4,639,157 to Herzfeld discloses a sectionalized folder wherein papers are stored. U.S. Pat. No. 3,905,538 to Ohlson describes a filing member manufactured from a singular material and including a provision for a label. U.S. Pat. No. 4,583,764 to Steffen discloses a folder with integrally-positioned flaps to hold documents.

Several document organizers have been pursued which employ clips or similar retainers to securely hold papers inside folders. In U.S. Pat. No. 4,174,909 to Jahn a Folder with a securing means is disclosed wherein clip-like fasteners are used to secure sheets of paper. U.S. Pat. No. 4,402,530 to Daguerre discloses a folder wherein spring-like clips are employed to hold papers in place. U.S. Pat. No. 4,229,022 to Grundell teaches a folder employing resilient metallic projections to secure papers.

Many hangable organizers for documents have been developed. In U.S. Pat. No. 4,530,176 to Rejwan an organizer disclosed wherein a folder including a hanging means is suspended upon a pair of rails. Similar patents are disclosed wherein folders are suspended in like manner, especially U.S. Pat. No. 4,400,107 to Pitts, U.S. Pat. No. 3,885,726 to Fridlund et al., U.S. Pat. No. 4,053,057 to Snowden, U.S. Pat. No. 4,294,028 to Remond, and U.S. Pat. No. 3,977,799 to Schudy et al.

Several suspendable organizers for documents have been created which hang by a centrally positioned hook or hooks. Such devices are disclosed in U.S. Pat. No. 4,285,555 to Hedstrom et al., U.S. Pat. No. 3,980,360 to Wright et al., and U.S. Pat. No. 3,865,445 to Dean et al.

While these devices perform well for many applications, they do not provide a suitable means for cataloging, storing, and displaying pertinent information. Additionally, the prior art does not allow a file folder device which provides a physician the easy and immediate access to organized patient medical information.

SUMMARY OF THE INVENTION

It is therefore an object of this invention to provide a novel medical file folder and hanging system. It is another object of this invention to provide a medical file folder which can securely hold, catalog, and display patient medical information and documents. It is a further object of this invention to provide a medical file folder and hanging system which permits easy and immediate access to pertinent patient medical information. It is a still further object of this invention to provide a medical file folder and hanging system which is easily retrievable, especially important in the event of a medical emergency.

These, as well as other objects, are accomplished by a medical file folder comprising a front and back contrapositioned walls with a common foldable spine therebetween. Pertinent patient medical information is displayed and stored on a medical chart printed on the exterior of the front wall of the folder. Medical documents are stored in a pocket of a transparent sheet connected to the back wall of the folder. Additionally, the medical file folder includes a resilient clamp and openable pockets therein for storage of patient information. The medical file folder is easily cataloged by having an identification tab positioned on one edge of front wall. A pair of suspension hooks positioned on the medical file folder allow easy storage on and retrieval from a suspension bar.

DETAILED DESCRIPTION

In accordance with this invention it has been discovered that a medical file folder utilizing a number of means for the storage and display of pertinent patient medical information possesses superior use characteristics. It has further been found that a medical file folder including a pair of suspension hooks can be easily retrieved from and replaced on a suspension bar. It has additionally been found that a medical file folder having an identification tab on which a patient's name and number can be placed provides for easy cataloging. While the specification concludes with claims particularly pointing out and distinctly claiming the subject matter which is regarded as the invention—in light of the doctrine of equivalence, it is believed that the invention, the objects, features, and advantages thereof will be better understood from the following description taken in connection with the accompanying drawings.

Figure 1:
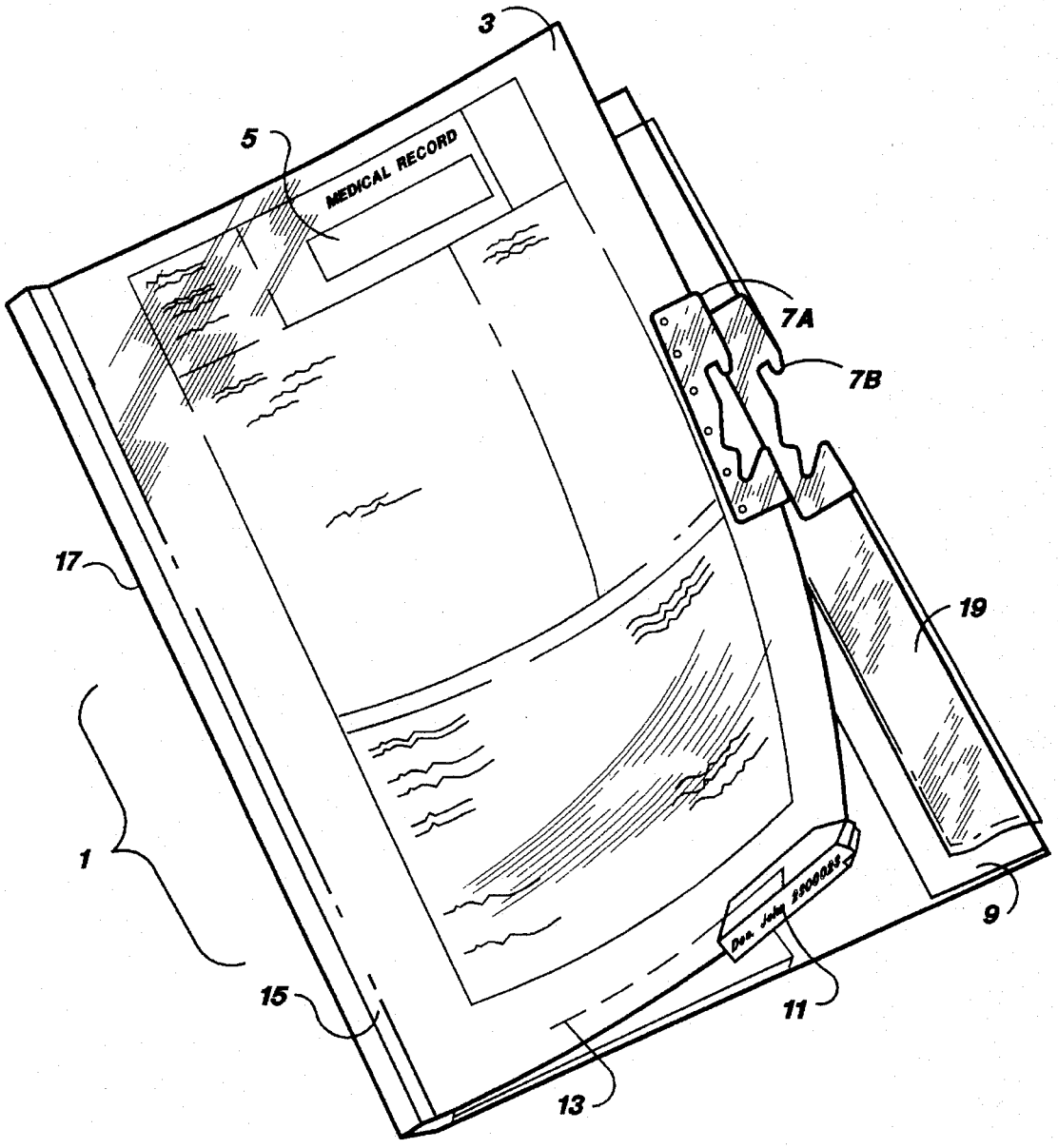
FIG. 1 of the drawings illustrates a frontal view of a medical file folder in accordance with this invention.

FIG. 1 of the drawings illustrates a frontal view of a medical file folder 1 in a closed position. In accordance with this invention, the folder 1 illustrated here comprises a front wall 3 and a back wall 9 with a common foldable spine 17 therebetween. The folder 1 may be manufactured from any flexible material heretofore utilized such as cardboard, plastic, or the like. A medical chart 5 is printed on front wall 3 and contains a standard form on which patient medical history is entered by a physician. Blood-type, allergies, medical intolerances, and similar information is contained thereon and allows the physician to quickly review, at a glance, pertinent medical data. Permitting folder 1 to be catalogued and identified from suspension bar 35, an identification tab 11 containing a patient's name and number is inserted in any of apertures 13 which extend along one edge of front wall 3 below chart 5. A pair of proportionately disposed suspension hooks 7*a* and 7*b* consisting of a rigid metallic, plastic, or similar material are centrally riveted on each edge of walls 3 and 9 opposite spine 17. Suspension hooks 7*a* and 7*b* are of such design and shape as to communicate with and connect to a suspension bar 35 of complementing shape as disclosed in FIG. 4. A number of serrations 15 are parallel and proximately disposed to spine 17 and allow for the expansion of walls 3 and 9 should a large number of papers or documents be stored therebetween.

Figure 2:
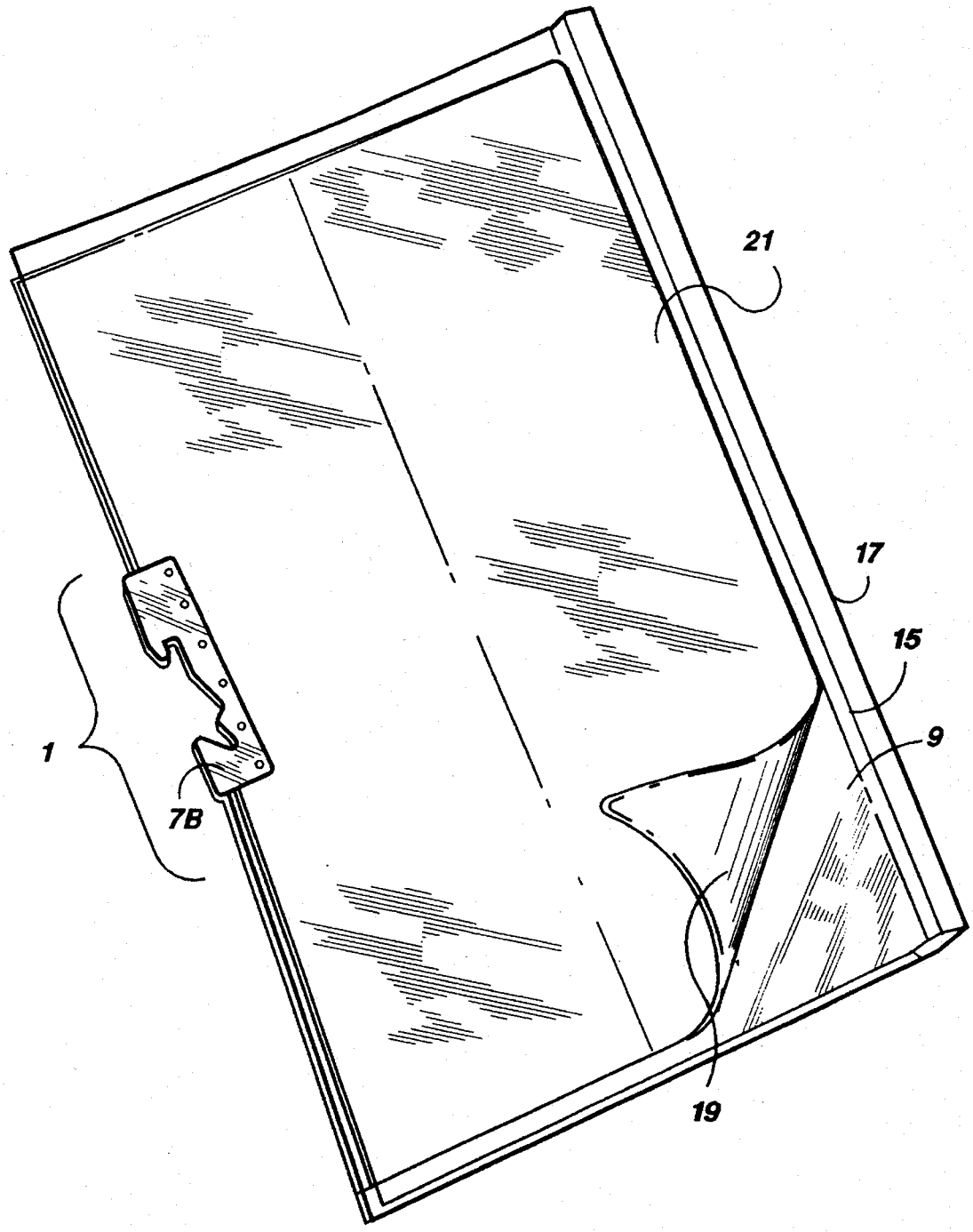
FIG. 2 of the drawings illustrates the back portion of a medical file folder in accordance with this invention.

FIG. 2 of the drawings illustrates the back portion of folder 1 which consists of a flexible transparent sheet 19 wherein one of its edges is folded over back wall 9 and is secured thereon by suspension hook 7*b*. Medical records and documents can be stored inside pocket 21 positioned on inner side of sheet 19. Pocket 21 as well as sheet 19 comprise a transparent plastic material which is both durable and flexible. Pocket 21 generally consists half of width of sheet 19.

Figure 3:
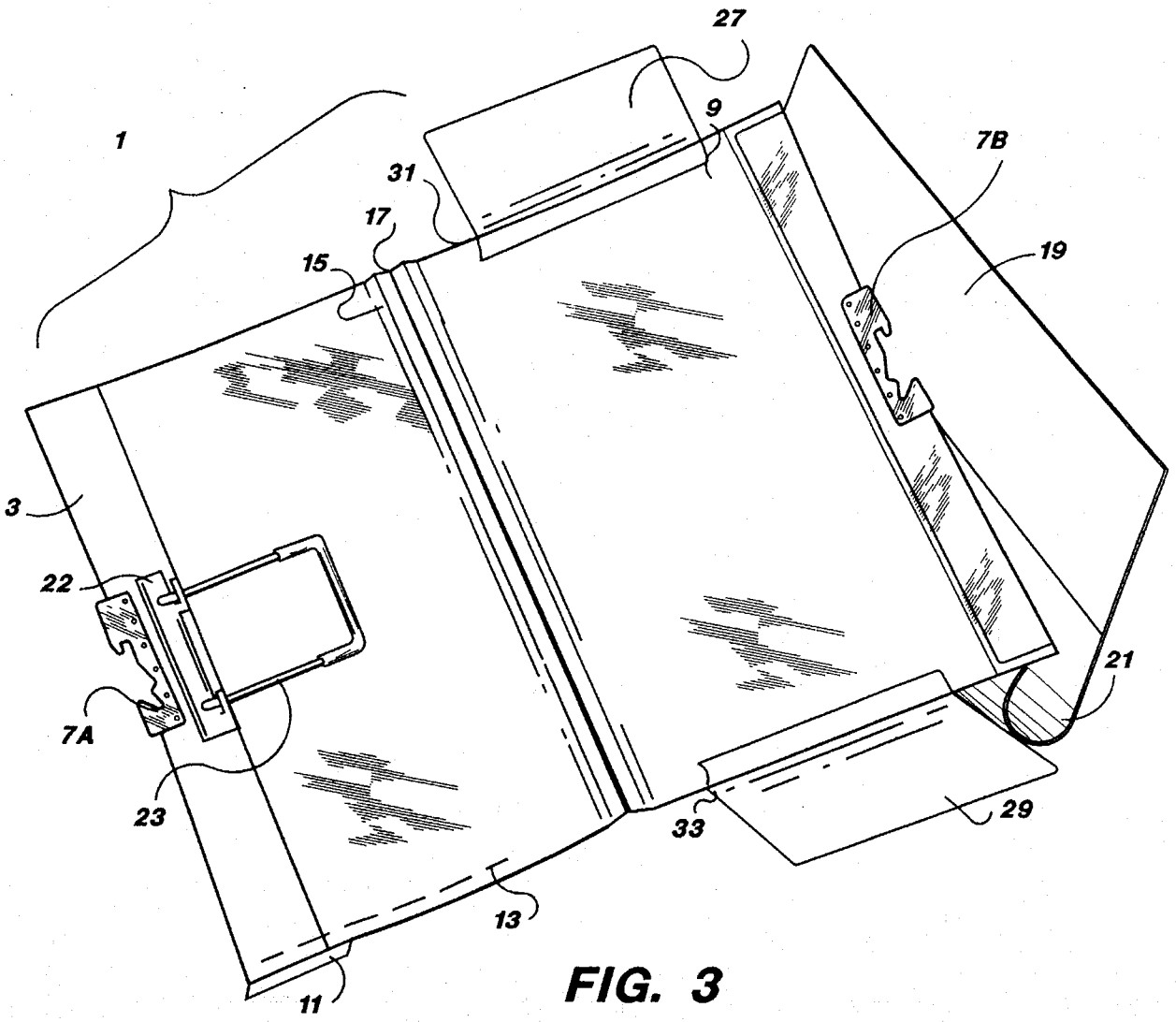
FIG. 3 of the drawings illustrates the interior portion of a medical file folder in accordance with this invention.

FIG. 3 of the drawings illustrates the interior portion of folder 1 wherein various material handling means are located. Flaps 27 and 29 are opposingly disposed, by gluing or other means, on opposite edges of interior side of back wall 9 and do not overlap. Folding seams 31 and 33 allow flaps 27 and 29 to be openable. When closed, flaps 27 and 29 form pockets in which medical files are stored. Disposed below suspension hook 7*a*, a rectangular clamp 23 includes a base 22 attached by riveting or similar means along the interior edge of front wall 3 opposite spine 17. Clamp 23 extends medially toward spine 17 and terminates at half the width of front wall 3. Clamp 23 is resilient and spring-like and securely holds papers in place by a downward clamping motion.

Figure 4:
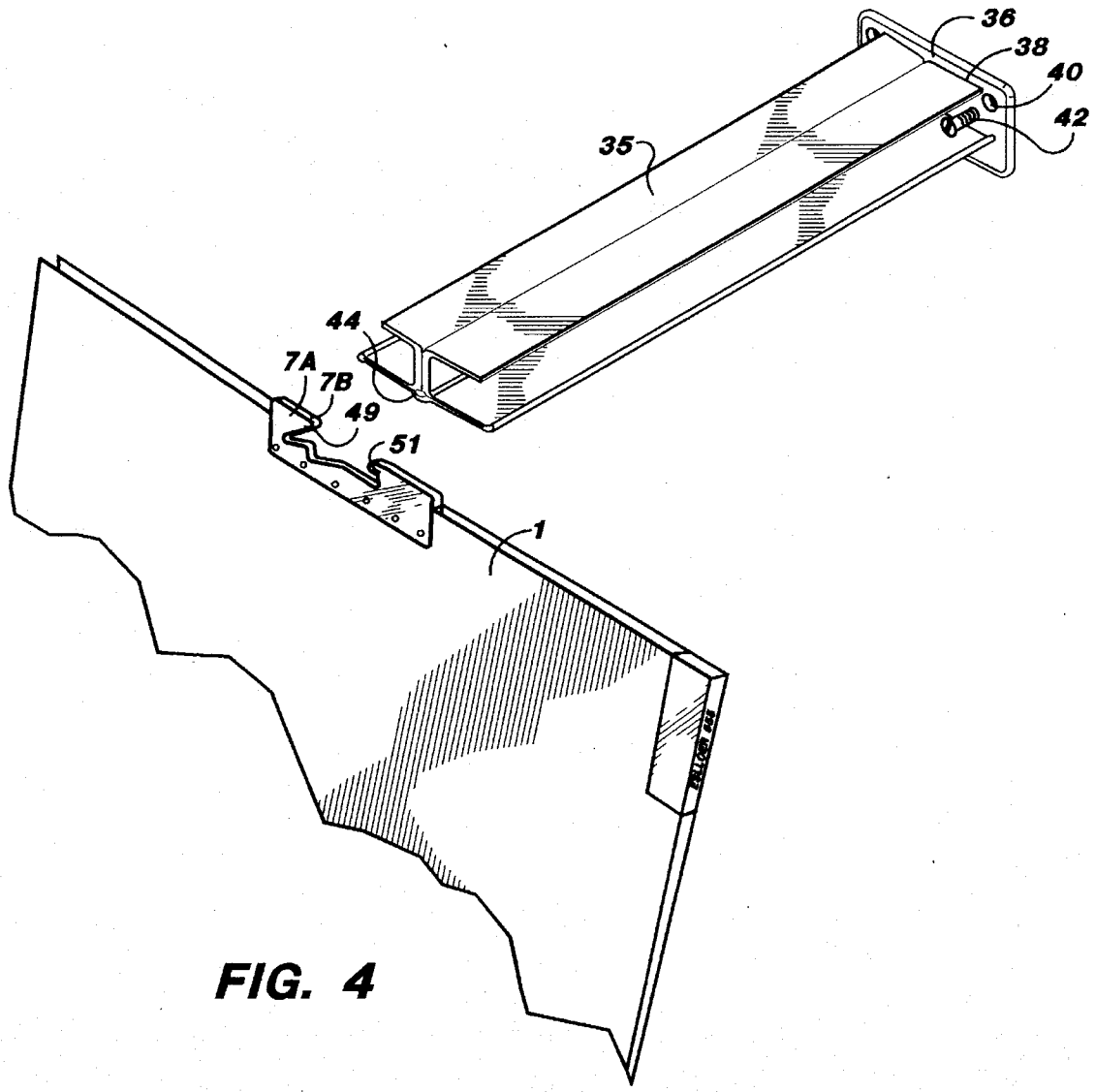
FIG. 4 of the drawings illustrates a suspension bar in accordance with this invention.
Figure 5:
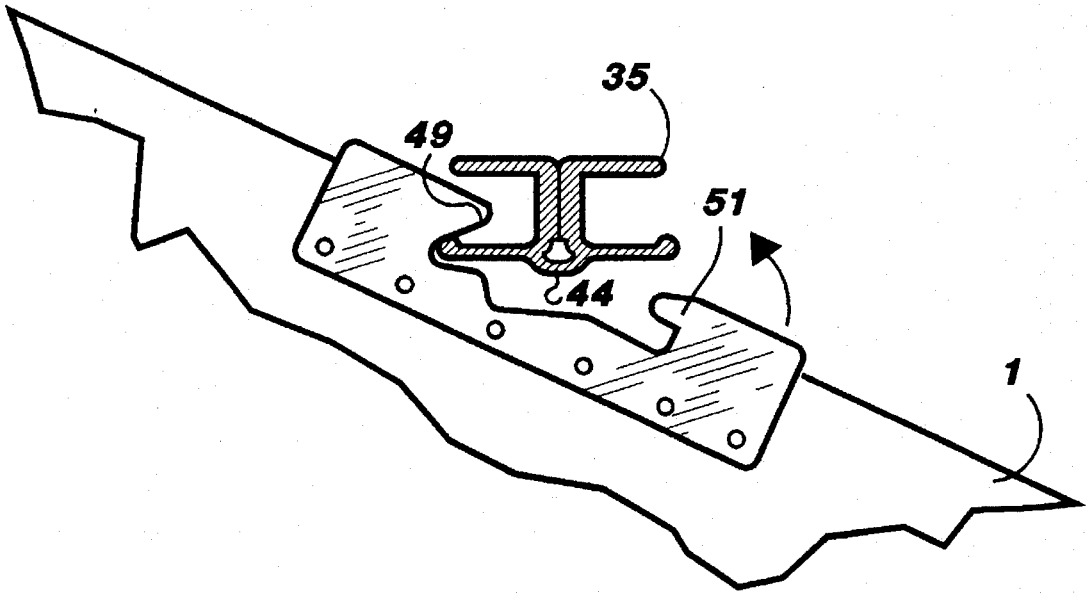
FIG. 5 of the drawings illustrates a medical file folder as suspended from a suspension bar in accordance with this invention.

In accordance with this invention, FIG. 4 of the drawings illustrates a suspension bar 35 fabricated from a rigid metal, plastic or similar material. The suspension bar illustrated here comprises a substantially I-shape to simultaneously receive and hold suspension hooks 7*a* and 7*b* of folder 1. A raised portion 44 on the underside of suspension bar 35 runs the length thereof and communicates with suspension hooks 7*a* and 7*b*. Fabricated of a rigid metal, plastic or similar material and able to receive end portions of suspension bar 35, anchoring units 36 include apertures 38 which are of the same substantially I-shape as suspension bar 35. During installation, the ends of suspension bar 35 simply slip into apertures 38 and anchoring units 36 are secured to a flat surface, such as a wall, by fastening devices 42, such as screws or the like, which pass through holes 40. Because of their complementing shape, suspension hooks 7*a* and 7*b* allow folder 1 to horizontally slide upon suspension bar 35. Folder 1 can be quickly removed from suspension bar 35 by a slight pulling and downward tilting of folder 1 which disengages suspension hooks 7*a* and 7*b*. Folder 1 is easily replaced by attaching suspension hooks 7*a* and 7*b* to suspension bar 35 by first hooking longer lip portions 49 of suspension hooks 7*a* and 7*b* then pulling forward slightly and then hooking shorter lip portions 51 of suspension hooks 7*a* and 7*b*, as illustrated in FIG. 5.

It is thus apparent in accordance with this invention a superior container for records has been developed wherein a medical file folder comprises a front wall having a medical history chart thereon, a back wall having a transparent pocketed sheet wherein medical documents are stored and are readily visible, and an interior containing a clamp and pockets to securely hold papers in place. An improved filing system has also been provided wherein the medical file folder is easily retrievable and storable on a suspension bar.

As various modifications become apparent to those familiar with the art, such modifications may be practiced without departing in any way from the spirit of the following appended claims:

That which is claimed is:

1. A medical file folder comprising a front and back contrapositioned walls having a common foldable spine therebetween, said folder including:

a pair of suspension hooks proportionately riveted in central position on each edge of said walls opposite said spine, said suspension hooks fashioned of a rigid metal, plastic or similar material and each having a longer lip and a shorter lip;

a flexible transparent sheet connected along one of its edges to said back wall at a point opposite said spine and held in place by one of said suspension hooks, said sheet containing a pocket positioned on the inner side thereof;

a plurality of apertures linearly disposed along one edge of said front wall, said apertures allowing insertion of an identification tab;

a top and bottom openable flaps opposingly arranged on opposite edges of interior side of said back wall, said flaps extending toward but not overlapping one another and including folding seams allowing said flaps to form pockets when closed;

a rectangular clamp having a base attached along interior edge of said front wall opposite said spine, said clamp extending medially from said base toward said spine and terminating at half the width of interior of said front wall.

2. A medical file folder as recited in claim 1 wherein exterior of said front wall includes a medical chart on which patient medical records are kept such as blood-type, medical intolerances, and the like.

3. A medical file folder as recited in claim 1 wherein said folder includes a plurality of serrations parallel and proximately disposed to said spine allowing expansion of said walls to hold a large number of papers or documents.

4. A medical file folder as recited in claim 1 wherein said clamp is a resiliently bendable projection under which papers are placed to be securely held.

5. A medical file folder as recited in claim 1 wherein said folder is stored by a means of suspension which comprises:

a suspension bar comprising an elongated and substantially I-shaped rigid metal, plastic or similar material, said suspension bar having a raised portion on its underside running the length thereof, said suspension bar communicating with and allowing said suspension hooks to be slidably positioned thereon;

two anchoring units fashioned of a rigid metal, plastic or similar material having apertures which are of the same said I-shape as said suspension bar, said anchoring units including a plurality of holes adjacent to said apertures, said apertures allowing insertion of ends of said suspension bar.

6. A medical file folder as recited in claim 5 wherein said suspension bar is of such shape to allow said suspension hooks to be removably hung thereon.

7. A medical file folder as recited in claim 5 wherein said holes allow for the insertion of fastening devices such as screws or the like.

* * * * *